US008234759B2

(12) United States Patent
Enga et al.

(10) Patent No.: US 8,234,759 B2
(45) Date of Patent: Aug. 7, 2012

(54) DEVICE FOR RELEASABLY SECURING TO A SUPPORT SURFACE

(75) Inventors: Agnete Enga, Brooklyn, NY (US); Kirsten Climer, New York, NY (US); Michael Lawrence Schumann, New York, NY (US); Jonathan Newman Cedar, Scarsdale, NY (US)

(73) Assignee: Staples The Office Superstore, LLC, Framingham, MA (US)

( * ) Notice: Subject to any disclaimer, the term of this patent is extended or adjusted under 35 U.S.C. 154(b) by 760 days.

(21) Appl. No.: 12/264,351

(22) Filed: Nov. 4, 2008

(65) Prior Publication Data

US 2010/0107373 A1 May 6, 2010

(51) Int. Cl.
*A44B 1/04* (2006.01)

(52) U.S. Cl. ..... 24/351; 24/354

(58) Field of Classification Search ..... 24/354, 24/355, 351; 16/4

See application file for complete search history.

(56) References Cited

U.S. PATENT DOCUMENTS

| | | | | | |
|---|---|---|---|---|---|
| 305,001 | A | * | 9/1884 | Hitt | 24/46 |
| 325,117 | A | | 8/1885 | Schroder | |
| 412,046 | A | | 10/1889 | Sheifer | |
| 457,783 | A | | 8/1891 | Kohnle | |
| 591,835 | A | | 10/1897 | Gosewisch | |
| 630,579 | A | | 8/1899 | Adams | |
| 984,190 | A | | 2/1911 | Camehl | |
| 1,202,412 | A | * | 10/1916 | O'Donnell | 24/354 |
| 1,212,630 | A | | 1/1917 | Guillet | |
| 1,392,950 | A | | 10/1921 | Lawrence | |
| 1,476,380 | A | * | 12/1923 | Toepper | 24/334 |
| 1,857,158 | A | | 5/1932 | Maloney | |
| 1,976,747 | A | | 10/1934 | Reuter et al. | |
| 2,021,730 | A | | 11/1935 | Jones | |
| 2,124,477 | A | * | 7/1938 | Thoeny | 269/54.4 |
| 2,194,709 | A | * | 3/1940 | McIntosh | 24/354 |
| 2,518,977 | A | | 8/1950 | Conway | |
| 2,550,549 | A | | 4/1951 | Goodstein | |
| 2,730,781 | A | | 1/1956 | Alunas | |
| 2,960,737 | A | * | 11/1960 | Kirsch et al. | 24/354 |
| 3,049,770 | A | | 8/1962 | Markoff-Moghadam | |
| 3,121,927 | A | | 2/1964 | Markoff-Moghadam | |
| 3,142,101 | A | | 7/1964 | Peterson | |
| 3,182,368 | A | | 5/1965 | Fair | |
| 3,296,673 | A | | 1/1967 | Kirkpatrick | |
| 3,955,462 | A | | 5/1976 | Thorsman | |
| 4,005,507 | A | | 2/1977 | Yamazaki | |
| 4,133,123 | A | | 1/1979 | Anderson | |
| 4,241,477 | A | * | 12/1980 | Freedom et al. | 24/67 R |
| 4,700,435 | A | | 10/1987 | Bush | |
| 4,901,962 | A | | 2/1990 | Greer | |

(Continued)

*Primary Examiner* — Robert J Sandy
*Assistant Examiner* — Michael Lee
(74) *Attorney, Agent, or Firm* — Wolf, Greenfield & Sacks, P.C.; Randy J. Pritzker

(57) ABSTRACT

A device for releasably securing to a support surface, such as a cork board, bulletin board and/or cubicle wall is provided. The device has a body, at least one pin movably coupled to the body for securing the body to a support surface, and an actuator coupled to the body and arranged to move the pin between a first position and a second position. The body may have a cavity and the pin may be movable between a first position where the pin is recessed within the cavity and a second position where the pin protrudes out of the cavity for securing the body to a support surface. In one embodiment, the device is a clip for releasably holding an object, such as paper, to the support device.

22 Claims, 8 Drawing Sheets

U.S. PATENT DOCUMENTS

| | | | | |
|---|---|---|---|---|
| 4,928,361 | A | 5/1990 | Brown | |
| 5,029,788 | A | 7/1991 | Hoskinson et al. | |
| 5,125,758 | A | 6/1992 | DeWan | |
| 5,269,485 | A | 12/1993 | Dwinell et al. | |
| 5,507,459 | A | 4/1996 | Kiera | |
| 5,553,363 | A * | 9/1996 | Chen | 24/353 |
| D420,282 | S | 2/2000 | Jones | |
| 6,196,782 | B1 | 3/2001 | Wagner et al. | |
| 6,276,030 | B1 | 8/2001 | Smith | |
| 6,279,862 | B1 | 8/2001 | Gershowitz | |
| 6,311,404 | B1 | 11/2001 | Smith | |
| 6,315,254 | B1 | 11/2001 | Maloney | |
| 6,325,345 | B1 | 12/2001 | Carpenter | |
| 6,363,582 | B1 | 4/2002 | Van Bladel et al. | |
| 6,471,169 | B1 | 10/2002 | Maloney | |
| 6,585,205 | B2 | 7/2003 | Beaty et al. | |
| 6,641,106 | B2 | 11/2003 | Beaty et al. | |
| 6,754,937 | B1 * | 6/2004 | Martin | 24/351 |
| 6,923,411 | B2 | 8/2005 | Chen et al. | |
| 7,004,703 | B2 | 2/2006 | Johnson et al. | |

* cited by examiner

DEVICE FOR RELEASABLY SECURING TO A SUPPORT SURFACE

FIELD OF INVENTION

The present invention relates to a device for releasably securing to a support surface, such as a cork board, bulletin board and/or cubicle wall.

BACKGROUND OF INVENTION

A push pin is a traditional item used to releasably secure an object, such as paper, to a support surface, such as a cork board, bulletin board and/or a cubicle wall. The push pin has a sharp end that pierces through the paper and extends into the support surface to releasably hold the paper to the support surface. A push pin typically has a plastic cap positioned on the other end of the push pin to prevent a user from injuring his/her hand when pressing the pin into the support surface.

SUMMARY OF INVENTION

In one aspect of the present invention, a device for releasably securing to a support surface is disclosed. The device includes a body having at least a front surface and a back surface, and a cavity extending into the back surface. The device further includes at least one pin pivotally coupled to the body for securing the body to the support surface. The at least one pin has a first end, and the at least one pin is movable between a first position where at least the first end of the at least one pin is recessed within the cavity, and a second position where at least the first end of the at least one pin protrudes out of the cavity for securing the body to a support surface. The device also includes an actuator coupled to the body, which is arranged to pivot the at least one pin between the first position and the second position.

In another aspect of the present invention, a device for releasably securing to a support surface is disclosed. The device includes a body having at least a front surface and a back surface and at least one pin pivotally coupled to the body for securing the body to the support surface. The at least one pin has a longitudinal axis, and the at least one pin is movable between a first position where the longitudinal axis of the pin is substantially parallel with the back surface of the body, and a second position where the longitudinal axis of the pin is not substantially parallel with the back surface of the body. The at least one pin is configured to secure the body to a support surface when the at least one pin is in the second position. The device also includes an actuator coupled to the body, which is arranged to pivot the at least one pin between the first position and the second position.

In yet another aspect of the present invention, a device for releasably securing to a support surface is disclosed. The device includes a body having a front component and a rear component, where the front component is pivotally coupled to the rear component for releasably holding an object positioned between the front component and the rear component. The device farther includes at least one pin movably coupled to the body for securing the body to the support surface. The at least one pin has a first end and the body having a cavity, where the at least one pin is movable between a first position where at least the first end of the at least one pin is recessed within the cavity, and a second position where at least the first end of the at least one pin protrudes out of the cavity to secure the body to a support surface. The device also includes an actuator coupled to the body, which is arranged to move the at least one pin between the first position and the second position to secure the body to a support surface.

In another aspect of the present invention, a device for releasably securing to a support surface is disclosed. The device includes a body having a front component and a rear component, where the front component is pivotally coupled to the rear component for releasably holding an object positioned between the front component and the rear component. The device further includes at least one pin movably coupled to the rear component of the body for securing the body to a support surface, where the at least one pin has a longitudinal axis. The at least one pin is movable between a first position where the longitudinal axis of the pin is substantially parallel with a back surface of the rear component of the body, and a second position where the longitudinal axis of the pin is not substantially parallel with the back surface of the rear component of the body, and the at least one pin is configured to secure the body to a support surface when in the second position. The device also includes an actuator coupled to the body, which is arranged to move the at least one pin between the first position and the second position to secure the body to a support surface.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
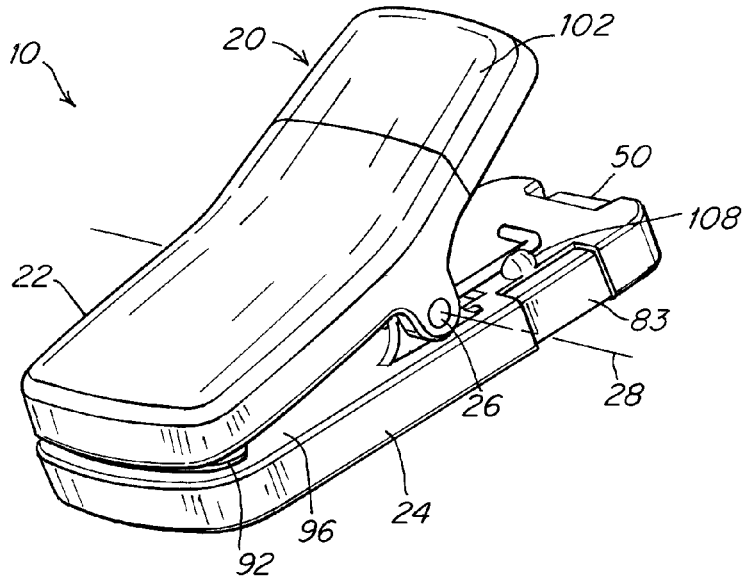
FIG. 1 is a perspective front view of a device according to one illustrative embodiment.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Aspects of the invention are directed to a device for releasably securing to a support surface, such as a cork board, a bulletin board, and/or a cubicle wall. The device may include at least one pin to secure the device to the support surface.

The device may include a wide variety of accessories, as the invention is not limited in this respect. As discussed in greater detail below, in one embodiment, the device is a clip for releasably holding an object, such as, but not limited to, one or more sheets of paper, to the support surface. In another embodiment, the device may include, but is not limited to, a mirror, a container, a cork board, and/or a white board. In one embodiment, the support surface is a cubicle wall, and a plurality of devices may be configured as a plurality of different office accessories which may be releasably secured to the cubicle wall.

Certain aspects of the invention are directed to a device for releasably holding an object, such as, but not limited to, one or more sheets of paper to a support surface. It should be appreciated that the device may be configured to releasably hold non-paper objects, such as, but not limited to pens, pencils, and other office accessories, as the invention is not so limited.

Applicant recognized that there were problems associated with the conventional approach of using push pins to secure objects, such as paper, to a support surface, because the sharp end of the push pin is always exposed. While handling the push pin, a user may inadvertently injure herself/himself with the sharp end. Certain aspects of the present invention are directed to minimizing this risk of injury by allowing a user to control the actuation of the end of the pin. In particular, aspects of the present invention are directed to a device having at least one pin to secure the device to the support surface where the pin is movable between a first position where the sharp end of the pin is not exposed, to a second position for securing the device to a support surface where the sharp end is exposed.

Applicant also recognized that push pins may be undesirable because they pierce a hole through the paper to secure the paper to the support surface. Aspects of the present invention are directed to a clip for releasably holding an object, such as paper, to a support surface, in a manner that does not pierce a hole through the object or otherwise damage the object. In one embodiment, the clip has a body including a front component and a rear component, and the front component pivots relative to the rear component to releasably hold an object between the front component and the rear component of the body.

In one embodiment, the device body has a cavity and the pin for securing the device to a support surface is movable into and out of the cavity. The pin may be movable between a first position where at least an end of the pin is recessed within the cavity and a second position where at least the end of the pin protrudes out of the cavity to secure the device body to the support surface. In this respect, the cavity in the device body may be provided to selectively house the sharp end of the pin.

In one embodiment, the pin for securing the device to a support surface has a longitudinal axis and the pin may be movable between a first position where the longitudinal axis of the pin is substantially parallel with a back surface of the device body and a second position where the longitudinal axis of the pin is not substantially parallel with the back surface of the device body. The pin may be selectively placed in the second position to secure the device body to a support surface.

Turning now to the drawings, it should be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings.

In FIGS. 1-16, a device 10 is illustrated. As mentioned above, in one embodiment, the device for releasably securing to a support surface is a clip. It should be appreciated that other embodiments may not include a clip and/or may include other office accessories, such as, but not limited to, a mirror, a container, a cork board and/or a white board, as the invention is not so limited.

In one illustrative embodiment, the device 10 includes a body 20 having a front component 22 and a rear component 24. The front component 22 is pivotally coupled to the rear component 24 for releasably holding an object, such as paper, positioned between the front and rear components 22, 24. In one embodiment, the front component 22 includes an axle 26 having an axis 28 and the front component 22 pivots relative to the back component 24 about axis 28. As mentioned above, the device 10 may be used to hold other non-paper objects as the invention is not so limited.

In one illustrative embodiment, the device 10 includes at least one pin 40 movably coupled to the body 20 for removably securing the body 20 to a support surface. In one embodiment, the pin 40 is coupled to the rear component 24 of the body 20. As discussed in greater detail below, the pin 40 is movable between a first position and a second position, and the pin is configured to secure the device 10 to a support surface when the pin 40 is in the second position.

In one embodiment, an actuator 50 is coupled to the body 20 and the actuator 50 is arranged to move the pin 40 between the first position and the second position. The actuator 50 may be configured such that a user must press the actuator 50 to move the pin 40 into the second position to secure the body 20 to the support surface. The actuator 50 may be configured such that the pin 40 returns back to the first position when the actuator is no longer pressed. It should be appreciated that in another embodiment, the actuator 50 may be configured differently as the invention is not so limited.

It should be appreciated that the device 10 of the present invention may be used with a variety of types of support surfaces, as the invention is not limited in this respect. A list of types of support surfaces include, but are not limited to cork boards, cubicle walls, bulletin boards and other surfaces that are capable of receiving and releasably holding an end of a pin 40.

Figure 2:
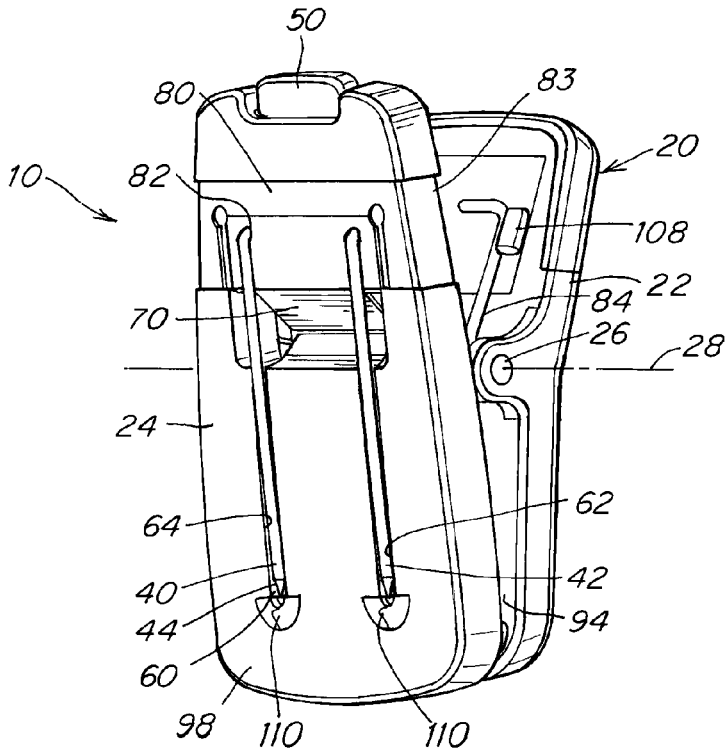
FIG. 2 is a perspective rear view of the device shown in FIG. 1.
Figure 4:
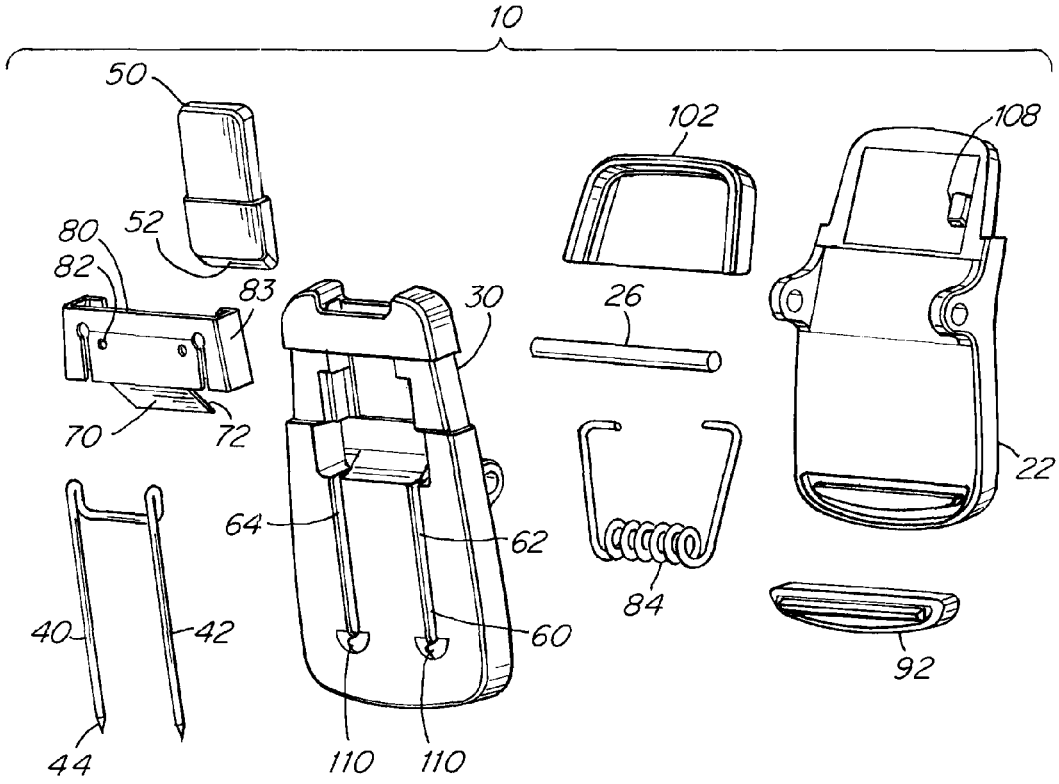
FIG. 4 is another exploded assembly view of the device shown in FIG. 1.
Figure 5:
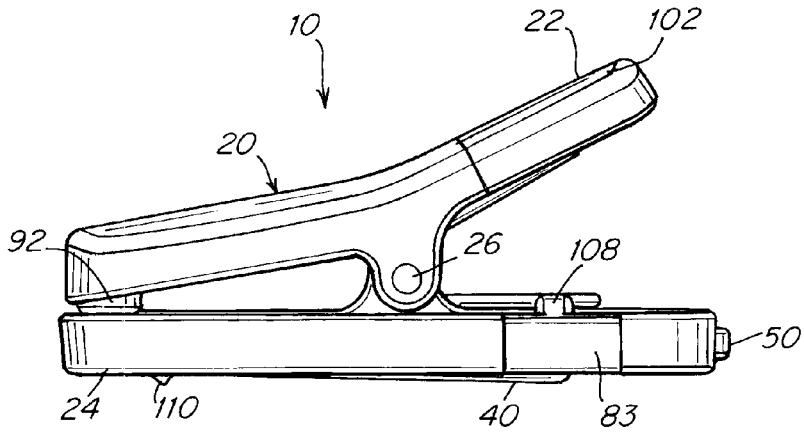
FIG. 5 is a side view of the device shown in FIG. 1.
Figure 6:
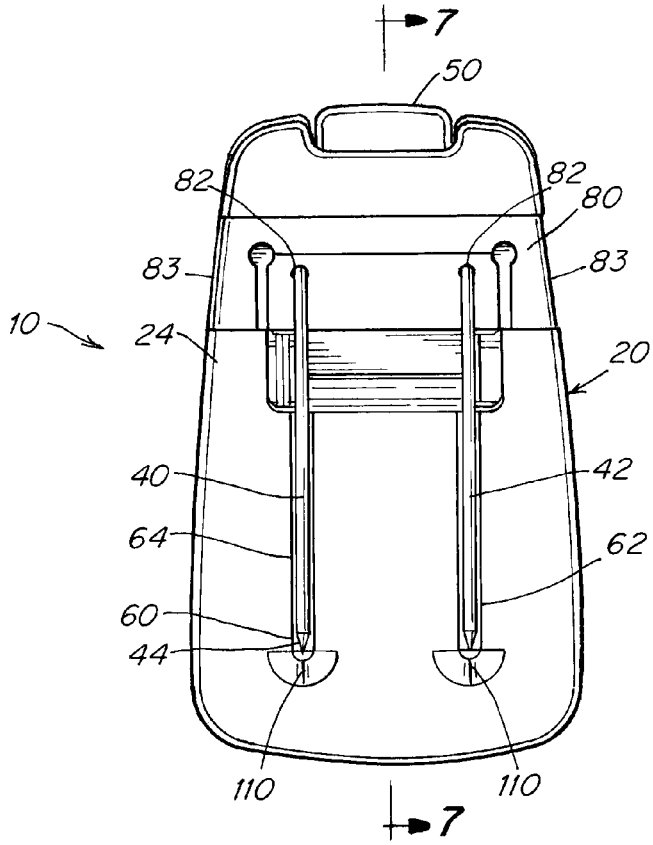
FIG. 6 is a rear view of the device shown in FIG. 1.
Figure 7:
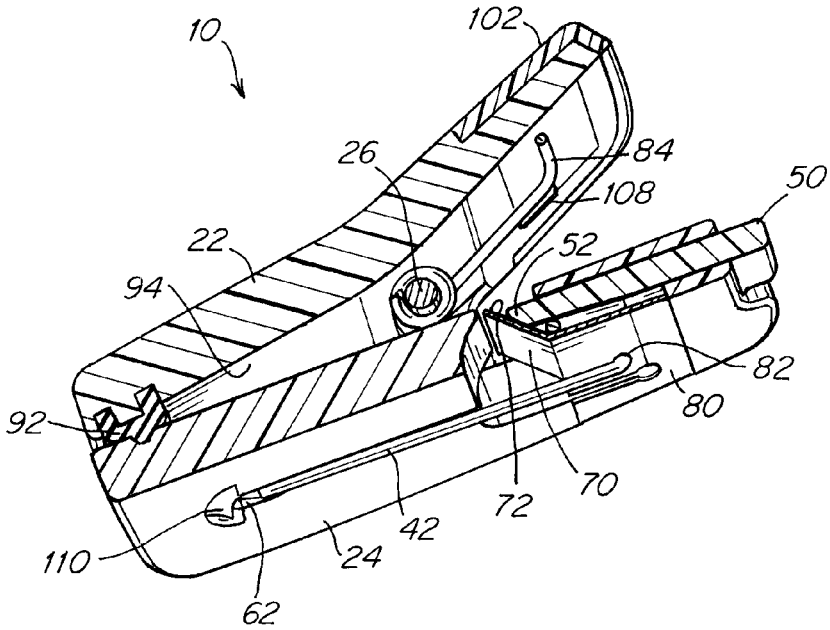
FIG. 7 is a rear perspective cross-sectional view of the device taken along line 7-7 shown in FIG. 6.
Figure 8:
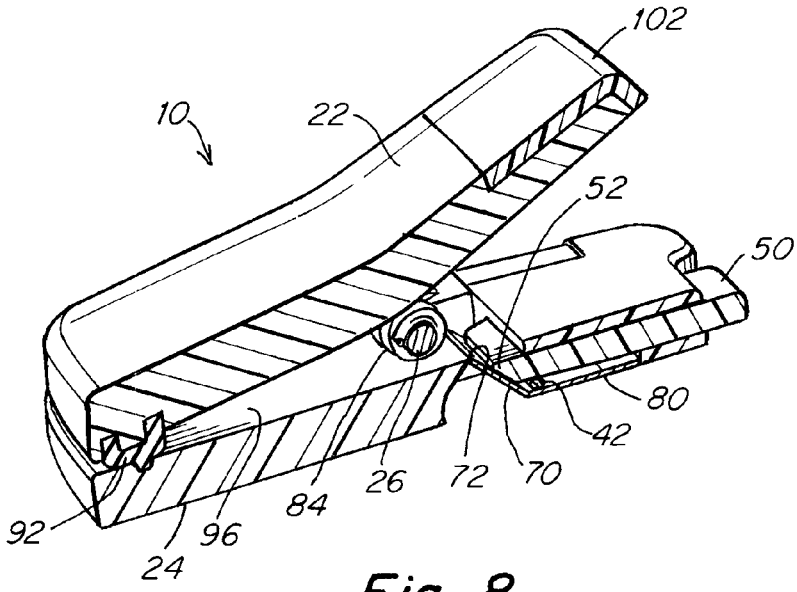
FIG. 8 is a front perspective cross-sectional view of the device taken along line 7-7 shown in FIG. 6.
Figure 9:
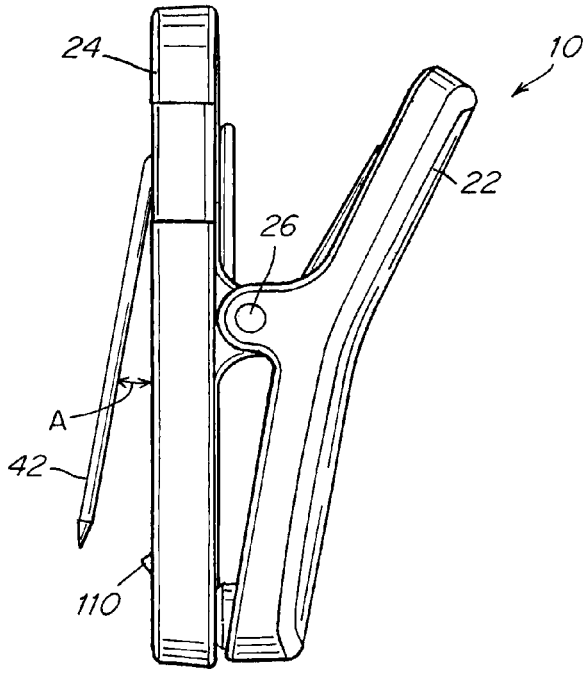
FIG. 9 is a side view of a device shown with at least one pin positioned in a second position to secure the body to a support surface.
Figure 10:
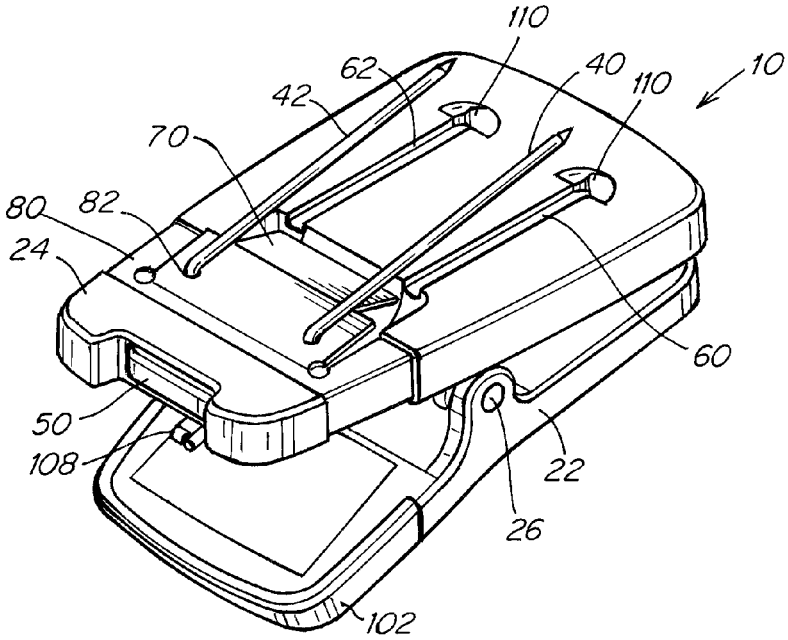
FIG. 10 is a rear perspective view of the device shown in FIG. 9.

As shown in FIGS. 2, 4 and 6, in one embodiment, the body 20 includes a cavity 60 and in the first position, the pin 40 is recessed within the cavity 60. As shown in FIGS. 9 and 10, in the second position, the pin 40 protrudes out of the cavity 60 to penetrate through at least a portion of the support surface to secure the body 20 to a support surface. It should be appreciated that in one embodiment, the pin 40 may be configured such that all or a substantial portion of the pin 40 is recessed within the cavity 60 and/or protrudes out of the cavity. In another embodiment, the pin 40 may be configured such that only a first end 44 of the pin 40 is recessed within the cavity 60 in the first position and/or that only a first end 44 of the pin 40 protrudes out of the cavity 60 in the second position.

In one embodiment, the pin 40 is pivotally coupled to the body 20 and the actuator 50 is configured to pivot the pin 40 between the first position and the second position. As shown in FIG. 9, in one embodiment, the pin 40 is arranged to pivot an angle A, at least approximately 10° between the first position and the second position. In another embodiment, the pin 40 is arranged to pivot at least approximately 20°, 45°, and/or 60° between the first position and the second position. In yet another embodiment, the pin 40 is arranged to pivot at least approximately 90° between the first position and the second position.

It should be appreciated that in another embodiment, the pin 40 may be coupled to the body 20 differently, and may, for example, move between the first position and the second position by non-rotational movement. For example, in one embodiment, the pin 40 may linearly move between the first position and the second position, as the invention is not so limited.

As shown in FIGS. 2-4 and 7-8, in one embodiment, the actuator 50 is a button and linear movement of the button 50 moves the pin 40 from the first position to the second position. As illustrated in FIGS. 3, 4, 7 and 8, in one embodiment, a lever 70 is coupled to the pin 40. The lever 70 may be coupled to the pin such that the pin 40 moves when the lever moves. In one embodiment, the pin 40 may be welded, or otherwise attached to the lever 70. In one embodiment, the lever 70 has at least one hole 82 (see FIGS. 3 and 4) and the pin 40 is configured to extend through the hole 82 to couple the pin 40 to the lever 70. The lever 70 and the pin 40 may be coupled to the body 20. In one embodiment, the lever 70 is coupled to a plate-like structure 80 that secures the lever 70 and the pin 40 to the body 20. The plate-like structure 80 may include arms 84 on each side which snap into grooves 30 formed onto each side of the rear component 24 of the body 20. It should be appreciated that in other embodiments, one or more of the above-mentioned components may be coupled to other components differently, as the invention is not so limited.

In one illustrative embodiment, the button actuator 50 is arranged to rotate the lever 70 to pivot the pin 40 between the first position and the second position. In one embodiment, the button actuator 50 includes a wedge-shaped portion 52 arranged to align with a mating surface 72 on the lever 70 to create rotational movement of the lever 70 and the pin 40.

It should be appreciated that in some embodiments, the device 10 may include more than one pin 40 for securing the device 10 to a support surface. For example, as shown in FIGS. 2-4 and 6, the device 10 has a first pin 40 and a second pin 42. Both pins 40, 42 may be configured to secure the body 20 to a support surface and the pins 40, 42 may be configured to move together between the first position and the second position. In one embodiment, the cavity 60 in the body 20 includes a first cavity portion 64 and a second cavity portion 62 and the first end 44 of the first pin 40 is configured to move in and out of the first cavity portion 64 between the first and second position and the first end of the second pin 42 is configured to move in and out of the second cavity portion 62. It should be appreciated that in embodiments having a plurality of pins 40, 42, the lever 70 may also have a plurality of holes 82 that couple the pins 40, 42 to the lever 70. In another embodiment, the device may include three, four or more pins 40, 42, as the invention is not limited in this respect.

Figure 3:
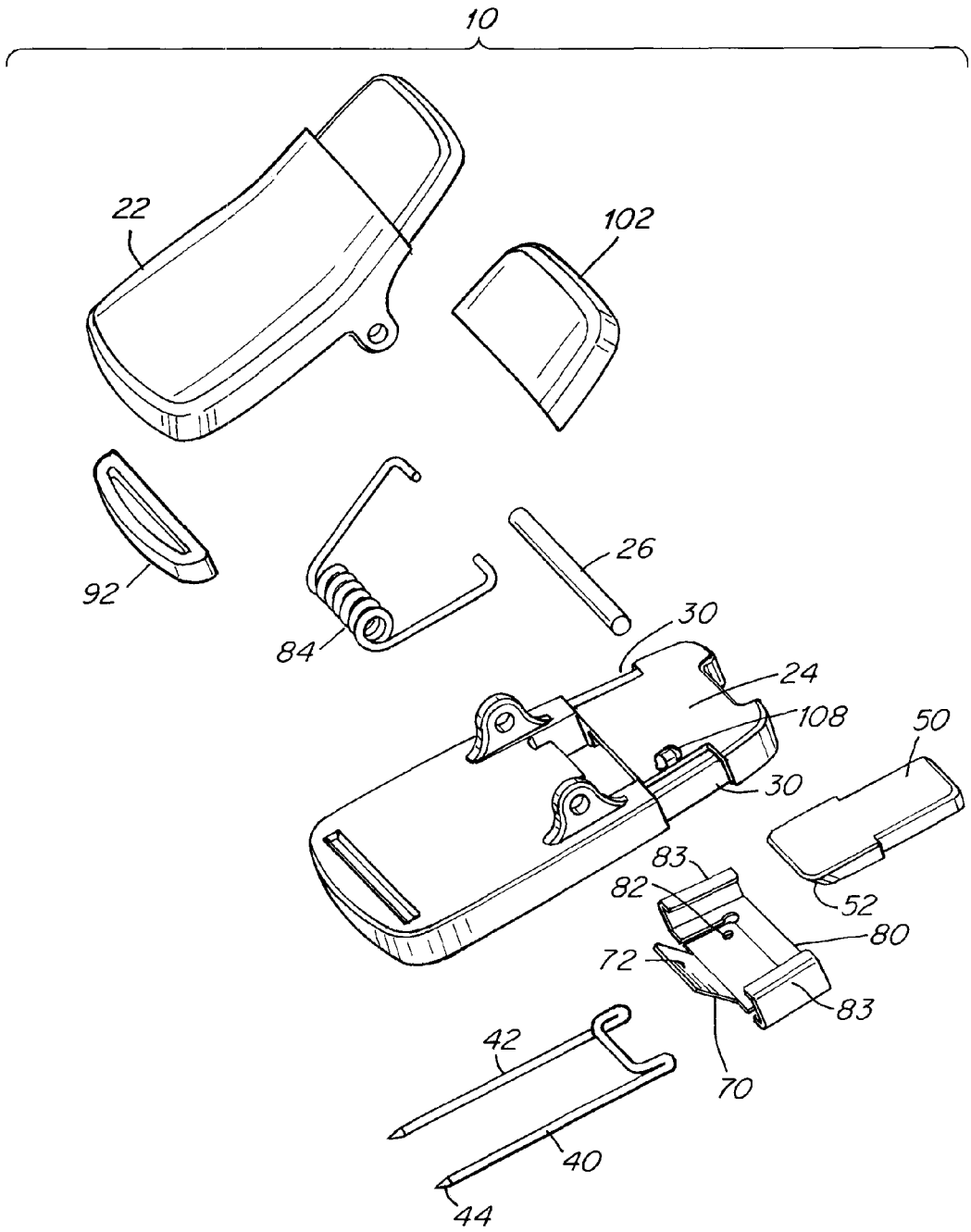
FIG. 3 is an exploded assembly view of the device shown in FIG. 1.

Furthermore, as shown in FIGS. 3-4, in one embodiment, the first pin 40 may be integrally formed with the second pin 42. It should be appreciated that in other embodiments, the first pin 40 may be separate from the second pin 42, as the invention is not so limited.

Figure 13:
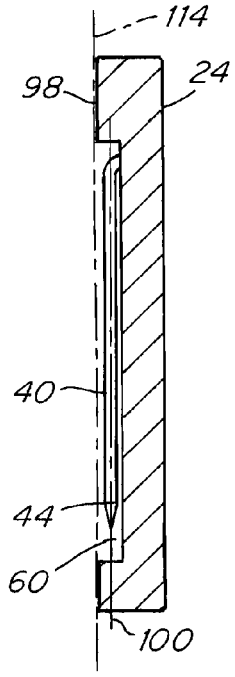
FIG. 13 is a schematic cross-sectional view of a device with the pin shown in a first position.
Figure 14:
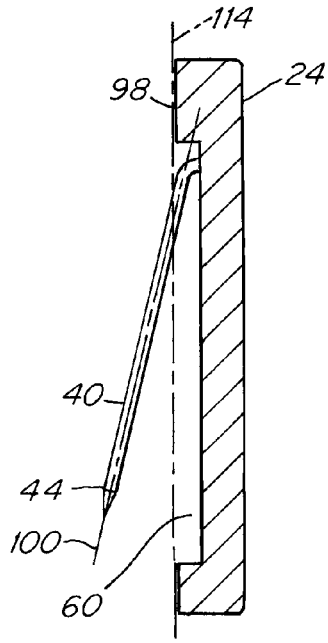
FIG. 14 is a schematic cross-sectional view of a device with the pin shown in a second position.

FIGS. 13 and 14 illustrate a device 10 with the pin 40 shown in the first and second positions. The device 10 shown in FIGS. 13 and 14 has a rear component 24. It should be appreciated that, for simplicity, the cross-sectional views shown in FIGS. 13-14 only illustrate the rear component 24 of the body 20 and the pin 40. The device may include some of the above-mentioned components, such as but not limited to, the actuator 50 and the lever 70. It should be recognized that the device 10 may also include additional components not illustrated in these figures, as the invention is not so limited. For example, in one embodiment, the device 10 may have a mirror attached to the rear component 24. In another embodiment, the device may have a cork board or a white board attached to the rear component 24, and in another embodiment, the device 10 may have a container attached to the rear component 24 for holding various office accessories.

As mentioned above, and as shown in FIGS. 13 and 14, in one embodiment, the pin 40 for securing the device 10 to a support surface has a longitudinal axis 100 and the pin 40 may be movable between a first position where the longitudinal axis of the pin is substantially parallel with a back surface 98 of the body (see FIG. 13) and a second position where the longitudinal axis 100 of the pin 40 is not substantially parallel with the back surface of the body (see FIG. 14). The pin 40 may be selectively placed in the second position to secure the body 20 to a support surface.

Figure 11:
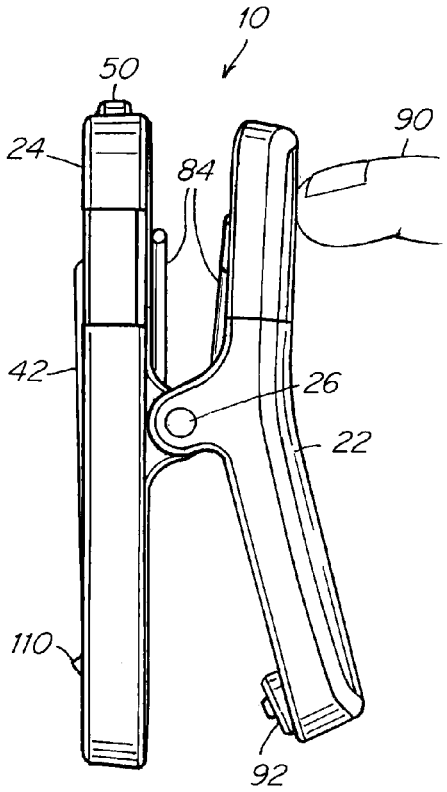
FIG. 11 is a side view of a device shown with a body in an open position.
Figure 12:
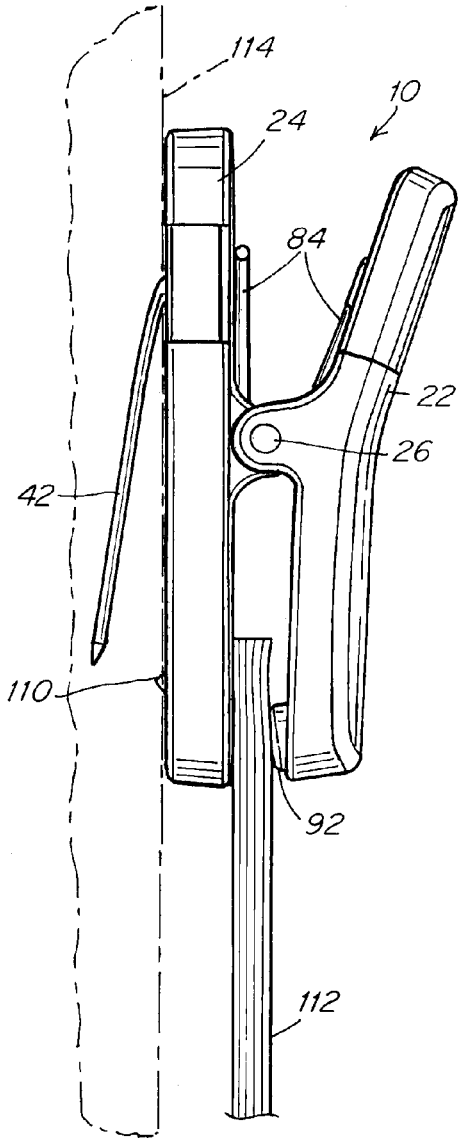
FIG. 12 is a side view of the device shown with a body in a closed position to releasably hold an object.

As shown in FIGS. 11 and 12, in one embodiment where the device 10 is a clip, the body 20 has an open position (see FIG. 11) for placing an object between the front component 22 and the rear component 24 and a closed position (see FIG. 12) for releasably holding the object between the front and rear components 22, 24. The device 10 may include a clip spring 84 coupled to the body 20 arranged to bias the device in the closed position. As shown in FIG. 11, a user may press his/her finger 90 on one end of the front component 22 to rotate the front component 22 from the closed position into the open position. The clip spring 84 may be configured such that the body 20 returns to the closed position once the user moves his/her finger away from body 20. In one embodiment, the clip spring 84 is a helical spring. However, it should be appreciated that in another embodiment, the clip spring 84 may be configured differently, and may, for example, be in the form of a leaf spring, as the present invention is not so limited.

In the embodiment illustrated in FIG. 12, a stack of paper 80 is releasably held between the front and rear components 22, 24 and the pin 42 is shown in the second position to secure the device 10 to a support surface 82.

It should be recognized that the body 20 may be configured into a variety of different shapes, as the invention is not so limited. In one illustrative embodiment, the rear component 24 of the body 20 is substantially planar in shape. In this embodiment, the back surface 98 of the rear component 24 may rest across a substantially planar support surface 82.

In one illustrative embodiment, the front component 22 of the body 20 is angled such that it includes a substantially V-shaped portion. This V-shape may enable the front component 22 to more readily pivot relative to the rear component 24. In one embodiment, the pin 26 and the axis 28 about which the front component 22 pivots relative to the rear component 24 is positioned substantially at the middle of the V-shaped portion of the front component 22. In this respect, the front component 22 can rock back and forth between the closed position and the open position.

As shown in FIGS. 3 and 4, in one illustrative embodiment, the front component 22 of the body 20 may include a plurality of discrete portions. In one embodiment, the front component 22 may include an outer cover 102 which may be formed of a higher friction material, such as a thermoplastic elastomer (TPE) to assist a user in applying a force to the front component 22 to rotate the front component 22 into an open position. The clip spring 84 may be coupled to the front component 22, and the front component 22 may include at least one arm 108 configured to hold at least an end of the clip spring 84.

Figure 15:
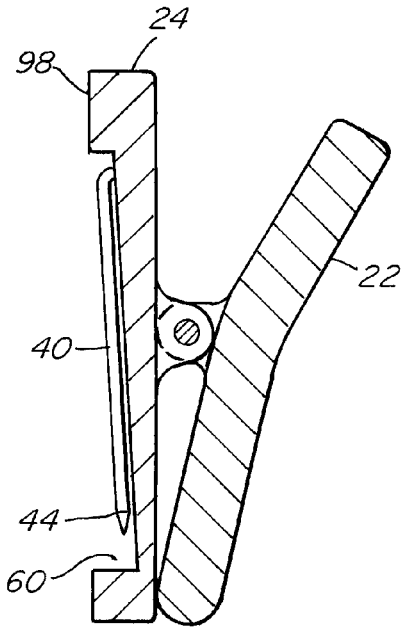
FIG. 15 is a schematic cross-sectional view of a device with the pin shown in a first position.
Figure 16:
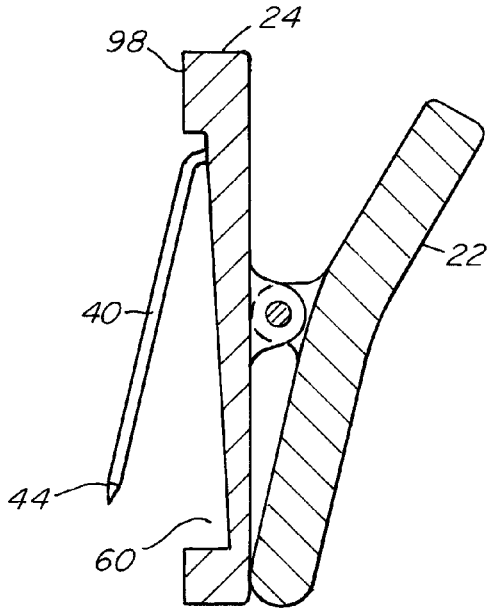
FIG. 16 is a schematic cross-sectional view of a device with the pin shown in a second position.

Turning to FIGS. 15 and 16, another embodiment of a device 10 is illustrated. In this embodiment, the pin 40 is angled toward the front component 22 of the body 10 when the first end 44 of the pin 40 is recessed within the cavity 60 in the first position (see FIG. 15). FIG. 16 illustrates the pin 40 angled away from the front component 22 of the body 20 with the first end 44 of the pin 40 protruding outside of the cavity 60 in the second position. As also shown in FIGS. 15 and 16, in one embodiment, the cavity 60 in the body is angled such that an end of the cavity 60 arranged to receive the first end 44 of the pin 40 is deeper than an opposite end of the cavity 60.

In one embodiment, the body 20 has at least one outwardly extending feature configured to shield the first end 44 of the pin 40. As shown in FIGS. 2 and 4-7, in one embodiment, a protrusion 110 extends outwardly from the back surface 98 of the rear component 24. The protrusion 110 may be positioned adjacent an end of the cavity 60, and may, for example, be positioned adjacent the end of the cavity which receives the first end 44 of the pin 40.

In one embodiment, the body 20 may include one or more gripping inserts 92 configured to retain an object, such as paper, positioned between the front and rear component 22, 24. The gripping insert may be made of a material such as rubber and the insert 92 may help clamp the object between the front and rear components 22, 24. In one embodiment, a gripping insert 92 is provided on both the inside surfaces 94, 96 of the front and rear components 22, 24. The gripping insert 92 may extend across the length of each of the front and rear components 22, 24.

As can be appreciated, the device 10 may be formed of any suitable material, as the present invention is not limited in this regard. In one embodiment, the front and rear components 22, 24 of the body 20, pins 40, 42, clip spring 84, actuator 50 and/or lever 70 may be formed of a metal or a plastic, as the invention is not so limited.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A device for releasably securing to a support surface, the device comprising:

a body having at least a front surface and a back surface, the body having a cavity extending into the back surface;

at least one pin pivotally coupled to the body for securing the body to the support surface, the at least one pin having a first end, wherein the at least one pin is movable between a first position where at least the first end of the at least one pin is recessed within the cavity, and a second position where at least the first end of the at least one pin protrudes out of the cavity for securing the body to a support surface; and a button actuator coupled to the body, the actuator constructed and arranged such that linear movement of the button actuator pivots the at least one pin between the first position and the second position.

2. The device of claim 1, wherein the device is a clip and the body further comprises a front component and a rear component, wherein the front component is pivotally coupled to the rear component for releasably holding an object positioned between the front component and the rear component.

3. The device of claim 1, further comprising a lever coupled to the at least one pin, wherein the button actuator is constructed and arranged to rotate the lever to pivot the at least one pin between the first position and the second position.

4. The clip of claim 3, wherein the button actuator comprises a wedge-shaped portion constructed and arranged to align with a mating surface on the lever to create rotational movement of the lever and the at least one pin.

5. A device for releasably securing to a support surface, the device comprising:

a body having at least a front surface and a back surface, the body having a cavity extending into the back surface;

at least one pin pivotally coupled to the body for securing the body to the support surface, the at least one pin having a first end, wherein the at least one pin is movable between a first position where at least the first end of the pin is recessed within the cavity such that the first end of the pin is angled toward the front surface, and a second position where the first end of the pin protrudes out of the cavity to secure the body to a support surface when the at least one pin is in the second position; and an actuator coupled to the body, the actuator constructed and arranged to pivot the at least one pin between the first position and the second position.

6. The device of claim 5, wherein the device is a clip and the body further comprises a front component and a rear component, wherein the front component is pivotally coupled to the rear component for releasably holding an object positioned between the front component and the rear component.

7. A device for releasably securing to a support surface, the device comprising:

a body having a front component and a rear component, wherein the front component is pivotally coupled to the rear component for releasably holding an object positioned between the front component and the rear component, the rear component having a cavity;

at least one pin movably coupled to the rear component for securing the body to the support surface, the at least one pin having a first end, wherein the at least one pin is pivotable between a first position where at least the first end of the at least one pin is recessed within the cavity, and a second position where at least the first end of the at least one pin protrudes out of the cavity in a direction opposite the front component for securing the body to a support surface; and an actuator separately formed from the pin and at least partially housed within the rear component, the actuator constructed and arranged such that linear movement of the actuator rotates the at least one pin between the first position and the second position.

8. The device of claim 7, wherein the at least one pin is movably coupled to the rear component of the body and wherein the cavity is in the rear component of the body.

9. The device of claim 7, wherein the at least one pin is constructed and arranged to pivot at least approximately 10° between the first position and the second position.

10. The device of claim 7, wherein the body has an open position for placing an object between the front and rear components and a closed position for releasably holding the object between the front and rear components, the clip further comprising:

a clip spring coupled to the body, wherein the clip spring is constructed and arranged to bias the body in the closed position.

11. The device of claim 10, wherein the clip spring is a helical spring.

12. The device of claim 7, further comprising a lever coupled to the at least one pin, wherein the actuator is constructed and arranged to rotate the lever to pivot the at least one pin between the first position and the second position.

13. The device of claim 12, wherein the actuator comprises a wedge-shaped portion constructed and arranged to align with a mating surface on the lever to create rotational movement of the lever and the at least one pin.

14. The device of claim 7, wherein the at least one pin includes a first pin and a second pin.

15. The device of claim 14, wherein the first pin and the second pin each have a first end and the cavity in the rear component of the body includes a first cavity portion and a second cavity portion, wherein the first end of the first pin and the first end of the second pin move together between the first position and the second position.

16. The device of claim 7, wherein the at least one pin has a longitudinal axis, and wherein the longitudinal axis of the pin is substantially parallel with a back surface of the rear component of the body when the at least one pin is in the first position, and wherein the longitudinal axis of the pin is not parallel with the back surface of the rear component of the body when the at least one pin is in the second position.

17. The device of claim 7, wherein the cavity extends into a back surface of the rear component and the rear component further comprises a protrusion extending outwardly from the back surface of the rear component adjacent an end the cavity, wherein the protrusion is configured to shield the first end of the at least one pin.

18. The device of claim 7, wherein the rear component of the body is substantially planar.

19. The device of claim 7, wherein the front component of the body is angled such that the front component includes a substantially V-shaped portion.

20. The device of claim 7, further comprising:

at least one gripping insert positioned on an inside surface of at least one of the front and rear components of the body, wherein the at least one gripping insert is configured to retain an object positioned between the front and rear components.

21. The device of claim 7, wherein at least the first end of the at least one pin is angled toward the front component when the first end of the at least one pin is recessed within the cavity in the first position.

22. The device of claim 21, wherein the cavity in the body is angled such that an end of the cavity arranged to receive the first end of the at least one pin is deeper than an opposite end of the cavity.

* * * * *